US011191983B2

(12) United States Patent
Hwang et al.

(10) Patent No.: US 11,191,983 B2
(45) Date of Patent: Dec. 7, 2021

(54) FIRE SUPPRESSING DEVICE

(71) Applicant: THE BOEING COMPANY, Chicago, IL (US)

(72) Inventors: Kyu-Pyung Hwang, Newton, MA (US); Young Kyu Song, San Diego, CA (US)

(73) Assignee: THE BOEING COMPANY, Chicago, IL (US)

( * ) Notice: Subject to any disclaimer, the term of this patent is extended or adjusted under 35 U.S.C. 154(b) by 255 days.

(21) Appl. No.: 16/190,247

(22) Filed: Nov. 14, 2018

(65) Prior Publication Data

US 2020/0147424 A1 May 14, 2020

(51) Int. Cl.
*A62C 3/08* (2006.01)
*A62C 13/76* (2006.01)

(52) U.S. Cl.
CPC ..... *A62C 3/08* (2013.01); *A62C 13/76* (2013.01)

(58) Field of Classification Search
CPC .. A62C 3/07; A62C 3/08; A62C 5/004; A62C 5/008; A62C 99/0027; A62C 99/0045; A62C 99/0018; A62C 37/28; A62C 37/11; A62C 35/62
USPC ..... 169/30, 36, 43, 46, 47, 50, 56–59; 252/5
See application file for complete search history.

(56) References Cited

U.S. PATENT DOCUMENTS

| | | | | |
|---|---|---|---|---|
| 2,411,409 | A * | 11/1946 | William | B05B 7/18 239/81 |
| 4,260,884 | A * | 4/1981 | Lovelock | H01T 19/00 250/324 |
| 7,988,847 | B2 * | 8/2011 | Duyvesteyn | B01F 5/0256 208/113 |
| 10,018,306 | B2 * | 7/2018 | Fanger | F17C 11/005 |
| 2015/0073164 | A1 * | 3/2015 | Nomura | C07C 45/38 556/115 |
| 2017/0087393 | A1 * | 3/2017 | Butler | A62C 99/0027 |

* cited by examiner

*Primary Examiner* — Alex M Valvis
*Assistant Examiner* — Christopher R Dandridge
(74) *Attorney, Agent, or Firm* — The Small Patent Law Group LLC; Joseph M. Butscher

(57) ABSTRACT

A fire suppressing device including a torus container with a main body defining an interior chamber and a discharge port, the interior chamber configured to receive and retain metal organic framework materials. The fire suppressing device also includes an inductor coil extending through the interior chamber of the torus container and surrounding the metal organic framework materials. The inductor coil is configured to heat the metal organic framework materials to form a fire suppressing substance that is conveyed through the discharge port.

20 Claims, 4 Drawing Sheets

FIRE SUPPRESSING DEVICE

FIELD OF THE DISCLOSURE

Embodiments of the present disclosure generally relate to a fire suppressing device, and, more particularly, to a fire suppressing device for an aircraft.

BACKGROUND OF THE DISCLOSURE

Fire suppressing, or extinguishing, devices are safety devices that are configured to be used in an emergency when a fire occurs. These devices include small portable containers that are typically placed at a known location. If a fire occurs, the portable container is carried to the location of the fire and a fire resistant substance is projected from the container to cover and suppress, and eventually extinguish the fire. These devices also include stationary containers that can include a sensor that detects when the substance contained within the container should be projected from the container.

Traditionally, the substance often being projected from any given fire extinguishing container has been halon based. Halon is a carbon with bromine and other halogens based substance that is effective at extinguishing fires. Unfortunately, halon substances have been found to deteriorate ozone, and thus has been regulated in many jurisdictions as harmful to the environment. As a result, extinguishing devices utilizing metal organic framework (MOF) materials that are placed in a container and heated have gained popularity.

However, such suppressing and extinguishing devices include several inefficiencies. For example, typically a solenoid coil is disposed within the container within the MOF materials to provide the desired heating to cause the MOFs to produce the fire suppressing substance that is then projected onto a fire. Such a coil does not provide even heating throughout the container. Additionally, the coil emits electromagnetic interference causing the use of such extinguishing devices to be undesirable in certain applications. For example, on aircraft, such electromagnetic interference can cause undesired communication deficiencies.

SUMMARY OF THE DISCLOSURE

A need exists for a fire suppressing and extinguishing device that efficiently operates without the use of harmful chemicals such as halon substances while also minimizing electromagnetic interference in the surrounding environment. Such a fire extinguishing device should also meet spatial, cost, and manufacturing requirements associated with traditional fire extinguishing devices. There are also requirements for on-board use which should consider capacity (volume and weight), rate of release and heat management.

With those needs in mind, certain embodiments of the present disclosure provide a fire suppressing device that includes a torus container including a main body defining an interior chamber and a discharge port, the interior chamber configured to receive and retain metal organic framework materials. An inductor coil is also provided extending through the interior chamber of the torus container and surrounding the metal organic framework materials. The inductor coil is configured to heat the metal organic framework materials to form a fire suppressing substance that is conveyed through the discharge port.

In at least one embodiment, a fire suppressing assembly is provided that includes a flow conduit with at least one discharge nozzle, and at least one fire suppressing device coupled to the flow conduit to convey a fire suppressing substance into the flow conduit. The at least one fire suppressing device includes a torus container including a main body defining an interior chamber and a discharge port, the interior chamber configured to receive and retain metal organic framework materials. The at least one fire suppressing device also includes an inductor coil extending through the interior chamber of the torus container. The inductor coil of the at least one fire suppressing device is configured to heat the metal organic framework materials to form the fire suppressing substance that is discharged into the flow conduit.

In at least one embodiment, a fire suppressing device is provided. The fire suppressing device includes a container including a main body defining an interior chamber, and a toroidal coil extending through the interior chamber of the container and surrounding metal organic framework materials to provide a uniform magnetic flux within the interior chamber when receiving current to heat the metal organic framework materials. The fire suppressing device also includes an electrically insulating barrier disposed between the toroidal coil and metal organic framework material. The metal organic framework materials form a fire suppressing substance when heated by the toroidal coil.

DETAILED DESCRIPTION OF THE INVENTION

The foregoing summary, as well as the following detailed description of certain embodiments will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular condition may include additional elements not having that condition.

Certain embodiments of the present disclosure provide a fire suppressing device that may be spatially adjusted in size to be a portable device, or a stationary device. A torus container is provided with a toroidally wrapped induction coil that forms a uniform magnetic flux density within the container. The induction coil thus heats metal organic framework (MOF) materials that are disposed within an interior chamber of the container. When heated, the MOF materials emit a fire suppressing substance that exits the container through a discharge port. Because of the shape of the torus container, the heating of the MOF materials is uniform, thereby improving heating efficiencies. Additionally, because the torus shape, a toroidal induction coil generates a uniform magnetic flux tightly confined within the toroidal coil volume, thereby reducing electromagnetic interference escaping the container and effecting nearby equipment.

Figure 1:
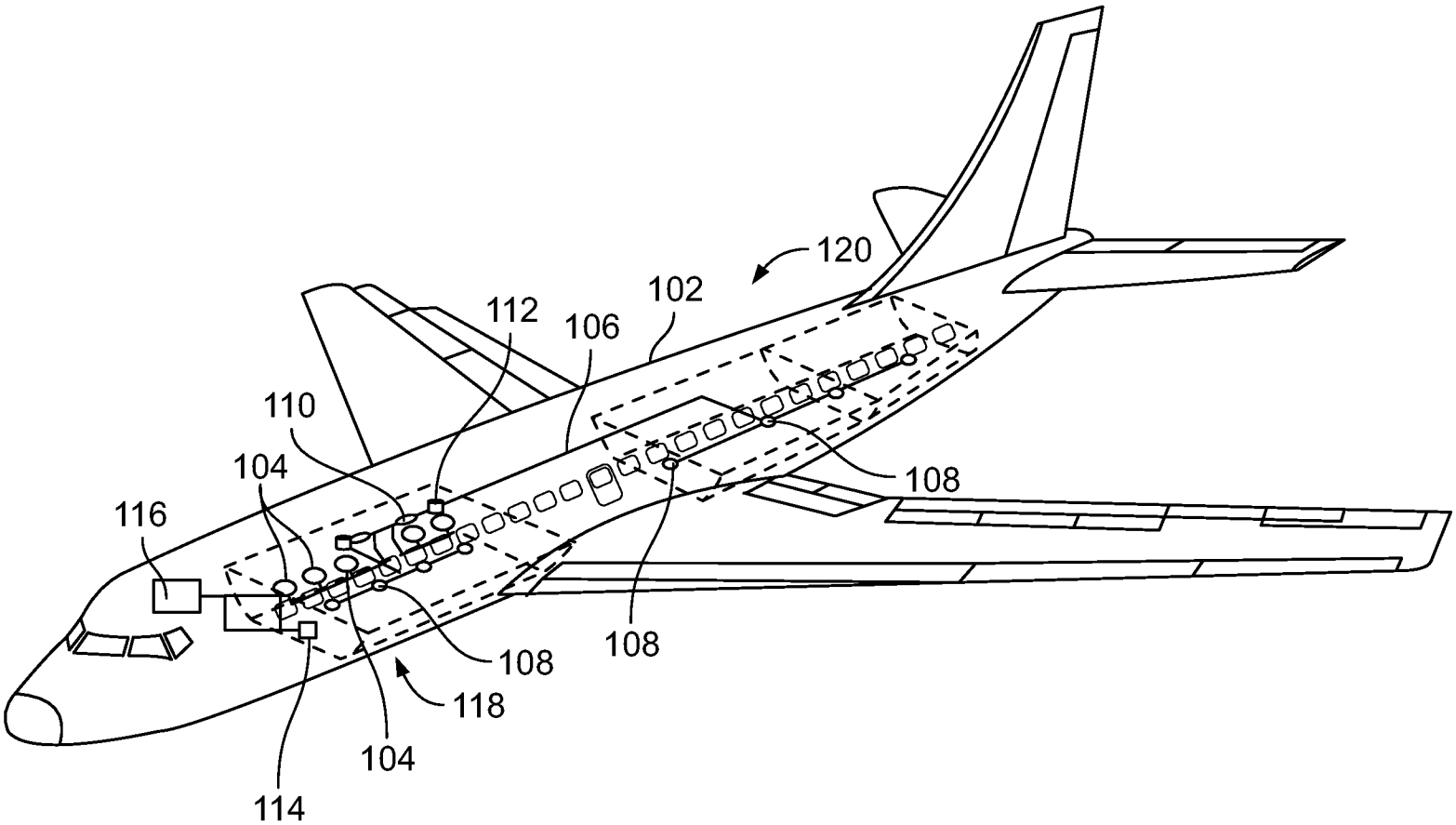
FIG. 1 is a cut-away perspective view of a fire extinguishing system of an aircraft according to an embodiment of the present disclosure.

FIG. 1 illustrates a cut-away perspective view of a fire extinguishing system 100 within an aircraft 102. The fire extinguishing system 100 includes a plurality of fire suppressing devices 104 that are coupled to a flow conduit 106 that includes a plurality of discharge nozzles 108. Flow valves 110 and pressure switches 112 are coupled within the flow conduit 106 to control the flow of fire resistance substance through the flow conduit 106 to the discharge nozzles 108. A sensor assembly 114 is electrically coupled to a control system 116 that is also operatively coupled to the fire suppressing devices 104, discharge nozzles 108, flow valves 110 and pressure switches 112 to regulate the flow of the fire resistance substance through the flow conduit 106 to the discharge nozzles 108.

The plurality of fire suppressing devices 104 are disposed within and coupled to the aircraft 102 at predetermined desired locations. In one exemplary embodiment the fire suppressing devices are secured to the aircraft 102 through welding, bonding, fasteners, including rivets and/or bolts, or the like. Alternatively, a frame is secured to the aircraft 102 through welding, bonding, fasteners, including rivets and bolts, or the like and the fire suppressing devices are removably secured within the frame. In this alternative embodiment, the suppressing devices 104 may be removed from the frame and replaced as needed.

In an exemplary embodiment, the fire suppressing devices 104 are disposed in side-by-side relation throughout the aircraft. In this exemplary embodiment, the fire suppressing devices 104 are within a forward cargo section 118 of the aircraft 102 and an aft cargo section 120. Each fire suppressing device 104 is fluidly connected to the discharge nozzles 108 through the flow conduit 106. In one example, the flow conduit 106 includes a generally cylindrical elongated body that is a hollow tube. In another embodiment the conduit is made from a composite plastic. In one example embodiment, the flow conduit 106 is of one-piece construction. Alternatively, the flow conduit 106 includes a plurality of conduit sections coupled together, including with elbows and the like. Thus, a fluid flow path is formed from each fire suppressing device 104 to a discharge nozzle via the flow conduit 106. In one example embodiment, the flow conduit extends from the forward cargo section 118 to the aft cargo section 120 to provide the fluid flow path to multiple sections and areas of the aircraft 102.

Each suppressing device 104 is configured to project a fire resistant, suppressing, and/or extinguishing substance through a discharge port into the flow conduit 106. The substance then flows through the flow conduit throughout the aircraft 102 to be discharged through the discharge nozzles 108 at desired locations. In one example embodiment a suppressing device 104 contains MOF materials. In particular, in one example embodiment the MOF materials are ferromagnetic materials that are combined with carbon dioxide in pellet form. An induction coil within the suppressing device is configured to receive an electric current and heat the MOF materials. When heated within the suppressing device, the ferromagnetic, carbon dioxide MOF materials release a carbon dioxide (CO2) based substance causing pressure to build within the suppressing device 104, resulting in the discharge of the CO2 substance through a discharge port of the suppressing device and into the flow conduit 106. In one example embodiment the carbon dioxide based substance only contains carbon dioxide. In other embodiments, the fire suppressing substance is a carbon dioxide based mixture.

While in this example embodiment the fire suppressing devices 104 are disposed within the forward cargo section 118 and the fire suppressing substance flows from the forward cargo section 118 to the aft cargo section 120, in other example embodiments, the fire suppressing devices 104 are located within the aft cargo section 120 and the fire suppressing substance flows from the aft cargo section 120 through the flow conduit 106 to the forward cargo section 118. Similarly, the fire suppressing device 104 and the flow conduits 106 may be located at different locations of the aircraft 102 as spatially desired to provide fire suppression where desired in the aircraft 102. Specifically, the flow conduit 106 and nozzles 108 are arranged as desired to reduce the space through which the fire extinguishing system is located, or to reduce the exposure a passengers and crew have to the fire extinguishing system.

The flow valves 110 and the pressure switches 112 of the fire suppressing system 100 control the flow and conveyance of the fire suppressing substance from the fire extinguishing devices 104 to the discharge nozzles 108. The flow valves 110 and pressure switches 112 ensure that flow conditions within the conduit 106 do not exceed a pre-determined threshold pressure within the flow conduit 106 to prevent damage to the flow conduit 106 or discharge nozzles 108, including blowouts. Specifically, each flow conduit 106 includes a predetermined safety level or rating that indicates the maximum, or threshold pressure, of fluid flowing through the conduit to ensure the conduit does not leak or rupture.

Alternatively, the flow valves 110 and pressure switches 112 ensure the pressure at which the substance is discharged through the nozzles 108 is sufficient to suppress or extinguish a fire. Thus, the flow valves 110 adjust flow to maintain optimal pressure within the flow conduit 106 when the fire suppressing substance flows through the flow conduit 106 during a fire suppressing or extinguishing event.

In one example embodiment, the sensor assembly 114 is electrically connected to the control system 116. In an example, the sensor assembly 114 includes a smoke detecting device that senses when smoke is in a predetermined location. Specifically, the sensor assembly 114 transmits signals though electronic connections to the control system 116. Electronic connections when used herein includes both wire connections and wireless connections. The control system 116 then receives the transmissions from the sensor assembly 114 at a receiver of the control system 116.

In one example embodiment, based on the transmissions the control system 116 indicates to the pilot, co-pilot, flight attendant, passenger, or the like of a condition, such as enhanced smoke levels. The control system 116 makes the indication through a sound, flashing button, voice notification, or the like. The pilot, co-pilot, flight attendant, passenger, or the like can then cause the fire suppressing substance to discharge from the discharge nozzles 108 when desired through a manual switch. Alternatively, in addition to indicating to the pilot, co-pilot, flight attendant, passenger, or the like of the pre-determined condition, such as detection of a threshold smoke level, the control system automatically causes the discharge of the fire suppressing substance through the discharge nozzles 108.

Figure 2:
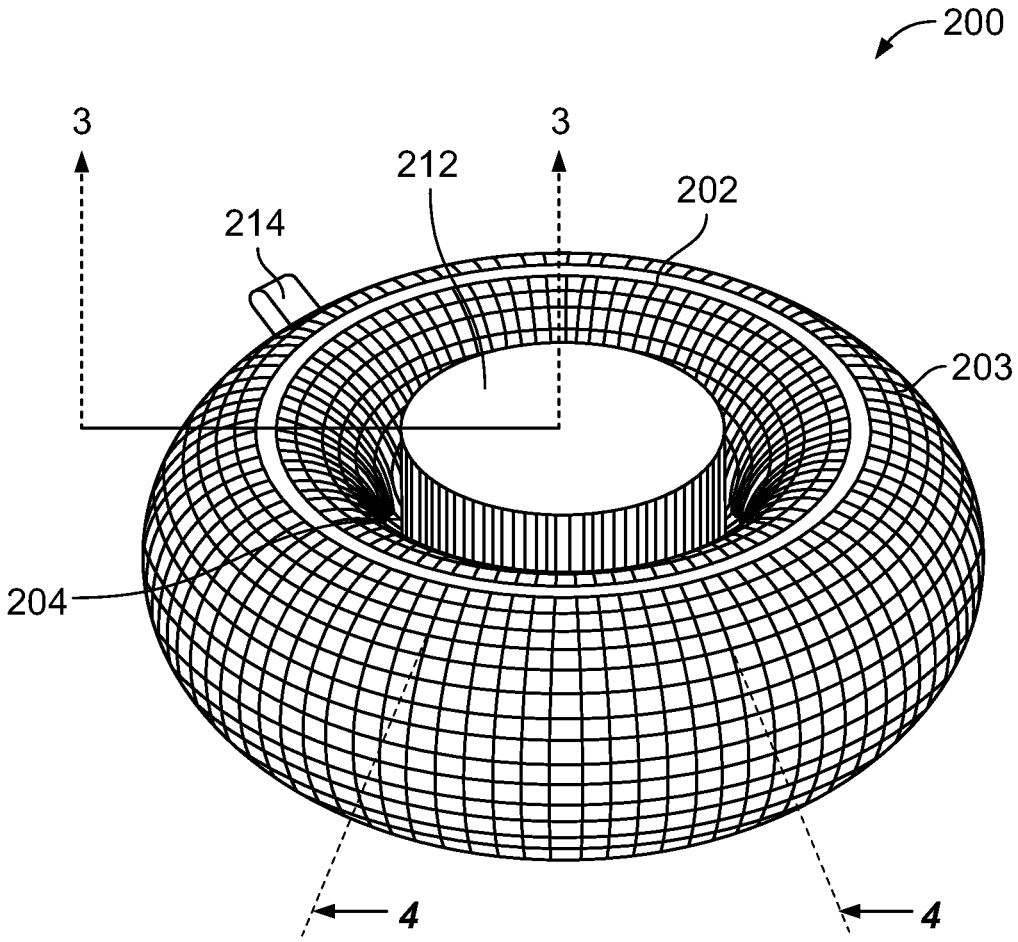
FIG. 2 is a perspective view of a fire extinguishing device according to an embodiment of the present disclosure.
Figure 3:
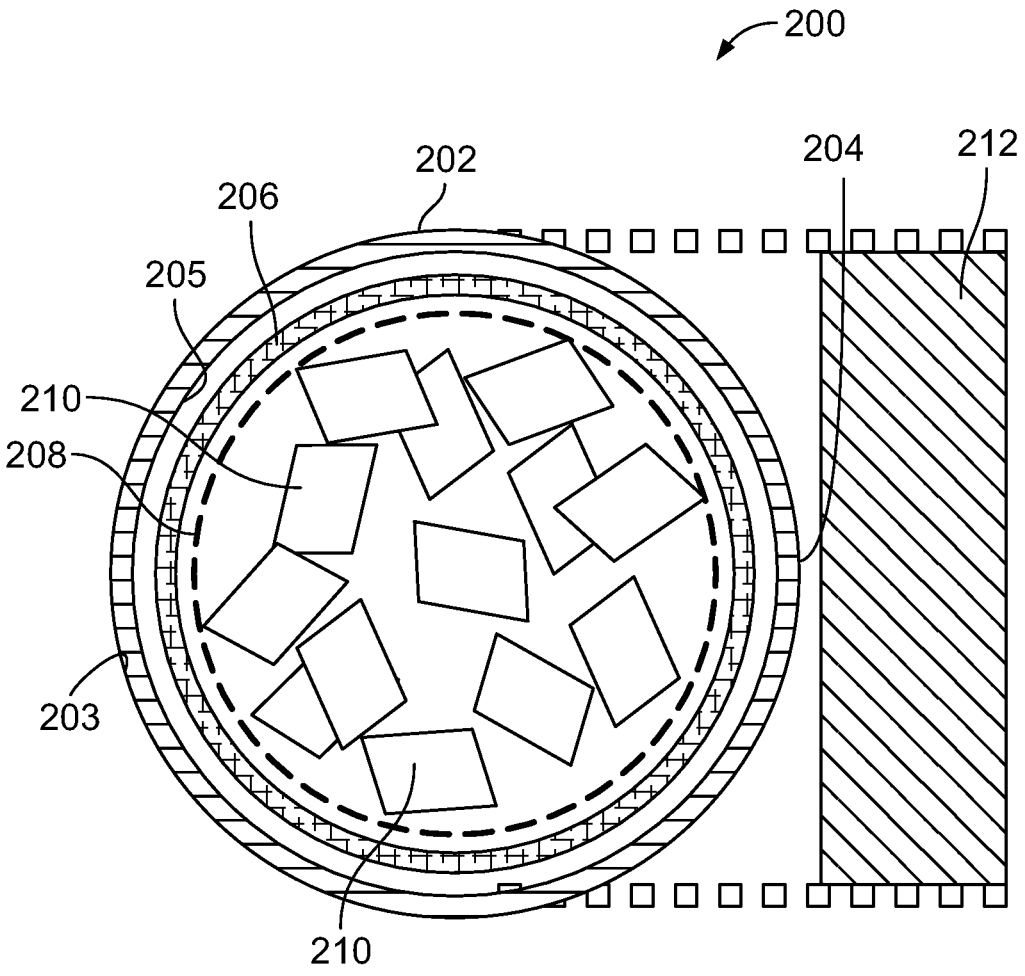
FIG. 3 is a section view of a fire extinguishing device taken along lines 3-3 in FIG. 2 according to an embodiment of the present disclosure.
Figure 4:
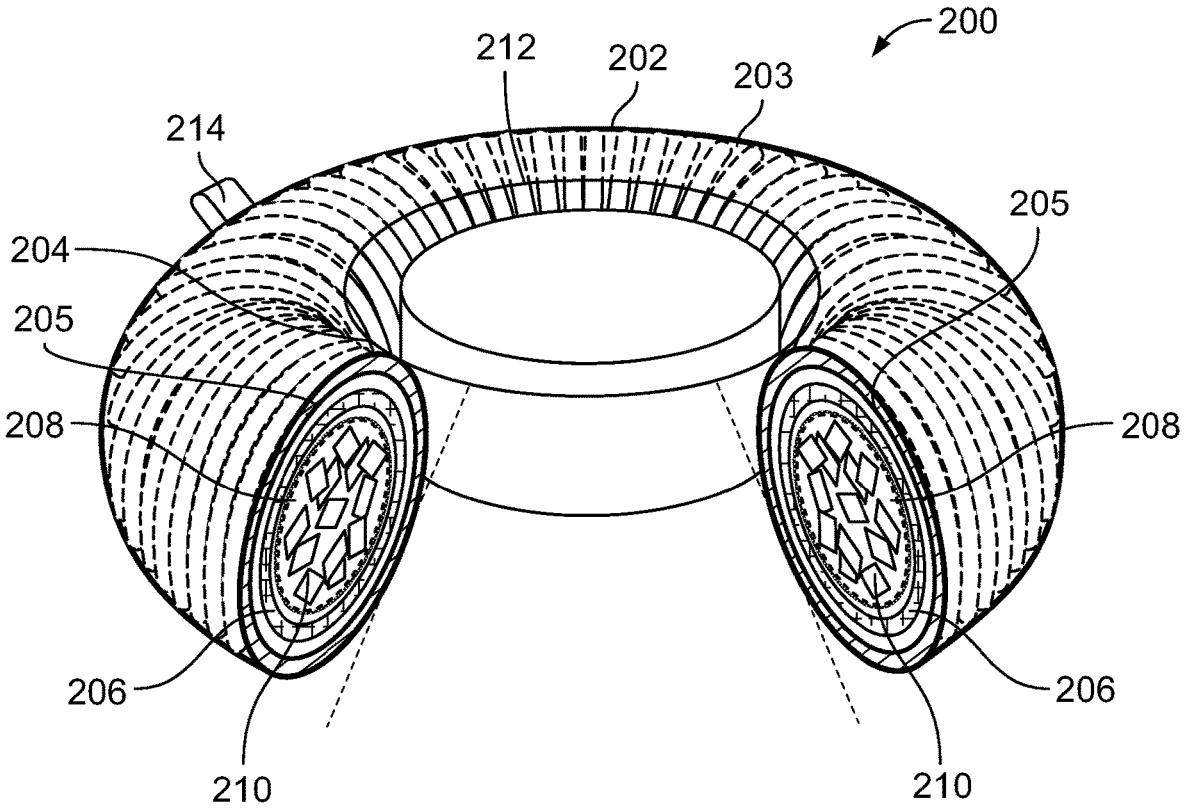
FIG. 4 is a cut-away perspective view of a fire extinguishing device taken along lines 4-4 in FIG. 2 according to an embodiment of the present disclosure.

FIG. 2 illustrates a perspective top view of an exemplary fire suppressing device 200, according to an embodiment of the present disclosure. FIG. 3 illustrates a sectional view of the exemplary fire suppressing device 200 taken along lines 3-3 in FIG. 2. FIG. 4 illustrates a cut-away perspective view of the exemplary first suppressing device 200 taken along lines 4-4 in FIG. 4. In one example, the fire suppressing device 200 shown and described with respect to FIGS. 2-4 is an example of the fire suppressing device 104 of FIG. 1. In one example, the fire suppressing device 200 is a portable device that is placed at a pre-determined location in order to suppress or extinguish a fire. In another example, the fire suppressing device 200 is a stationary device, such as illustrated in the example embodiment of FIG. 1, that is part of a system.

The fire suppressing device 200 includes a container 202 having a main body 203 extending around a central opening 204. The main body 203 defines an interior chamber 205 that is configured to receive an inductor coil 206, an insulative barrier 208, and MOF materials 210 with the insulative barrier disposed between the inductor coil 206 and the MOF materials 210. A power supply assembly 212 is received within the central opening 204 of the container to provide power to provide current to the inductor coil 206. A discharge port 214 extends from the main body 203 of the container and discharges the fire suppressing substance to suppress or extinguish a fire.

The container 202 in one exemplary embodiment may be shaped as a torus, or akin to a doughnut with the container 202 surrounding the central opening 204. In one example embodiment, the container 202 is made of a material, such as a carbon fiber composite, that is structurally strong with light weight. Therefore, the emission of electromagnetic radiation is reduced, and thus interference from the electromagnetic radiation emitted by the fire suppressing device 200 is reduced. Thus, the fire suppressing device 200 may be used around electrical equipment sensitive to electromagnetic radiation.

The inductor coil 206 in an example embodiment is a toroidal coil that is tightly wound within a torus container 202. The inductor coil 206 is made of any material that conducts electricity, including copper, silver, gold, platinum, and the like. In this example embodiment, as a result of the torus container 202 having a torus volume that contains a toroidal coil, a magnetic field is efficiently confined inside the interior chamber 205 volume. Consequently, magnetic flux leakage is greatly reduced, thereby minimizing or otherwise reducing electromagnetic interference radiation from the torus container 202. Additionally, within the interior chamber 205 of the torus container 202 the induction coil 206 uniformly heats the interior chamber such that the induction heating of the MOF materials 210 is efficient and uniform. Additionally, the torus shape provides a compact device form factor, reducing weight and cost of the fire suppressing device 200 and making the fire suppressing device 200 easy to handle in embodiments where the fire suppressing device 200 is portable.

The insulative barrier 208 provides a buffer layer between the MOF materials 210 and the inductor coil 206. In one example embodiment, the insulative barrier 208 is made of a non-conductive material such as a polytetrafluoroethylene (PTFE) based material. In another embodiment, the insulative barrier is a conduit that is disposed between the inductor coil 206 and the MOF materials 210. Specifically, the insulative barrier 208 prevents electrical conduction or coupling between the inductor coil 206 and the MOF materials 210 to prevent undesired shorting and interference. In this manner, the inductor coil 206 functions only as a heating element of device.

In an embodiment, the MOF materials 210 are ferromagnetic materials. In another example embodiment the MOF materials 210 are MOF-CO2 pellets of various shapes and sizes that enable the release of CO2 gas in a controlled manner within the container 202. Specifically, the MOF materials 210 when heated release a substance, like carbon dioxide that is able to be used to resist, suppress, and extinguish fire.

In one example, the power supply assembly 212 is removably coupled within the central opening 204 of the container 202 to provide current to the inductor coil 206. In one example the power supply assembly 212 includes a battery pack, and in another example the power supply assembly includes an electrical connector that receives current, and particularly AC current from a remote location. In one example the current is received from the battery, or power supply of an aircraft. In yet another embodiment, leakage current is used to supplement the power supply assembly 212. By coupling the power supply assembly 212 within the central opening 204, a compact, self-contained, spatially improved fire suppressing device 200 is provided. Still, in other embodiments, if spatially desired, the central opening remains open and the power supply assembly 212 is remote from the container 202. Such an arrangement allows a torus container 202 be hung on a rod or shaft improving storage capabilities.

The discharge port 214 provides an opening for conveying the fire suppressing substance formed from heating the MOF materials 210 from the interior chamber 205 of the container 202 to the exterior of the container 202. In one example, the discharge port 214 is a nozzle. In another example embodiment, when the fire extinguishing device 200 is portable, a valve mechanism (not shown) within the discharge port 214 controls the flow of fire suppression substance, such as CO2 based materials, through the discharge port 214. Specifically, when a user actuates the valve mechanism (not shown), through handle actuation, or otherwise, the fire suppression substance is discharged from the container 202.

In an alternative embodiment, the discharge port 214 is configured to be fluidly connected or coupled to a flow conduit such as the flow conduit 106 of FIG. 1 of a fire suppressing system 100. Consequently, when the inductor coil 206 heats the MOF materials 210, the resulting fire suppressing substance, such as CO2 based materials, discharge, or flow, through the discharge port 214 into the flow conduit 106. In such an embodiment, the fire suppressing material flows to the discharge nozzles 108 of the fire suppressing system 100, and a valve element can be either coupled to the discharge port 214 or remote from the discharge port 214 within a flow conduit 106 to control the flow of the CO2 based materials from the fire suppressing device 200 through the discharge port 214.

As described herein, embodiments of the present disclosure provide a fire suppressing device 200 that is versatile, compact, and efficiently heats MOF materials 210 to provide a fire extinguishing, or suppressing system. The fire suppressing device may be made of any size, including as a portable device in some examples, and as a larger stationary device in a fire suppressing system 100 in other examples. Also, while described within a fire suppressing system 100 of an aircraft 102, the fire suppressing device 200 can similarly be used in other fire suppressing assemblies not related to an aircraft. Specifically, in any application where reduced electromagnetic interference is desired, the fire suppressing device 200 provides such advantages. Additionally, the fire suppressing device eliminates the need to use halon substances, causing the fire suppressing device 200 to be environmentally friendly.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present disclosure. It is understood that the embodiments disclosed and defined herein extend to all alternative combinations of two or more of the individual features mentioned or evident from the text and/or drawings. All of these different combinations constitute various alternative aspects of the present disclosure. The embodiments described herein explain the best modes known for practicing the disclosure and will enable others skilled in the art to utilize the disclosure. The claims are to be construed to include alternative embodiments to the extent permitted by the prior art.

To the extent used in the appended claims, the terms "including" and "in which" are used as the plain-English equivalents of the respective terms "comprising" and "wherein." Moreover, to the extent used in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

Various features of the disclosure are set forth in the following claims.

The invention claimed is:

1. A fire suppressing device comprising:
- a torus container including a main body defining an interior chamber and a discharge port;
- metal organic framework materials disposed within the interior chamber of the torus container; and
- an inductor coil extending through the interior chamber of the torus container and surrounding the metal organic framework materials;
- wherein the inductor coil is configured to heat the metal organic framework materials to form a fire suppressing substance that is conveyed through the discharge port.

2. The fire suppressing device of claim 1, wherein the discharge port is configured to couple to a fire suppressing system.

3. The fire suppressing device of claim 1, wherein the metal organic framework materials include ferromagnetic materials and carbon dioxide pellets.

4. The fire suppressing device of claim 1, further comprising an insulative barrier disposed within the interior chamber of the torus container between the inductor coil and the metal organic framework materials and configured to prevent shorting between the metal organic framework materials and the inductor coil.

5. The fire suppressing device of claim 4, wherein the insulative barrier is formed from a polytetrafluoroethylene (PTFE) based material.

6. The fire suppressing device of claim 1, wherein the torus container surrounds a central opening housing a power supply assembly coupled to the inductor coil and configured to provide current to the inductor coil.

7. The fire suppressing device of claim 6, wherein the power supply assembly includes a battery.

8. The fire suppressing device of claim 1, wherein the inductor coil is a toroidal coil wrapped to provide a uniform magnetic flux within the interior chamber of the torus container.

9. The fire suppressing device of claim 1, wherein the torus container is portable.

10. A fire suppressing assembly comprising:
- a flow conduit including at least one discharge nozzle;
- at least one fire suppressing device coupled to the flow conduit and configured to discharge a fire suppressing substance into the flow conduit, comprising:
  - a torus container including a main body defining an interior chamber and a discharge port;
  - metal organic framework materials disposed within the interior chamber of the torus container; and
  - an inductor coil extending through the interior chamber of the torus container;
  - wherein the inductor coil is configured to heat the metal organic framework materials to form the fire suppressing substance that is discharged into the flow conduit.

11. The fire suppressing assembly of claim 10, wherein the at least one fire suppressing device further comprises:
- an insulative barrier disposed within the interior chamber of the torus container between the inductor coil and metal organic framework materials and configured to prevent shorting between the inductor coil and the metal organic framework materials.

12. The fire suppressing assembly of claim 10, further comprising a control system configured to control the current through the inductor coil of the fire suppressing device.

13. The fire suppressing assembly of claim 12, wherein the control system is manually controlled.

14. The fire suppressing assembly of claim 10, wherein the inductor coil is a toroidal coil.

15. The fire suppressing assembly of claim 10, wherein the torus container is made from a carbon fiber composite material.

16. The fire suppressing assembly of claim 10, wherein a uniform magnetic flux is formed in the interior chamber of the torus container.

17. The fire suppressing assembly of claim 10, further comprising a sensor assembly electrically connected to a control system configured to heat the inductor coil of the at least one fire suppressing device to heat the metal organic framework materials when smoke is detected.

18. The fire suppressing assembly of claim 10, wherein the at least one fire suppressing device is configured to couple to an aircraft.

19. A fire suppressing device comprising:
- a container including a main body defining an interior chamber;
- metal organic framework materials disposed within the interior chamber of the container;
- a toroidal coil extending through the interior chamber of the container and surrounding the metal organic framework materials, wherein the toroidal coil is configured to provide a uniform magnetic flux within the interior chamber when receiving current to heat the metal organic framework materials; and
- an insulative barrier disposed between the toroidal coil and metal organic framework materials;

wherein the metal organic framework materials form a fire suppressing substance when heated by the toroidal coil.

20. The fire suppressing device of claim 19, wherein the container is shaped as a torus.

* * * * *